US009761369B2

(12) United States Patent
Dien

(10) Patent No.: US 9,761,369 B2
(45) Date of Patent: Sep. 12, 2017

(54) COIL AND MANUFACTURING METHOD THEREOF

(71) Applicant: Ghing-Hsin Dien, Taipei (TW)

(72) Inventor: Ghing-Hsin Dien, Taipei (TW)

( * ) Notice: Subject to any disclaimer, the term of this patent is extended or adjusted under 35 U.S.C. 154(b) by 20 days.

(21) Appl. No.: 14/035,939

(22) Filed: Sep. 24, 2013

(65) Prior Publication Data

US 2014/0167899 A1 Jun. 19, 2014

(30) Foreign Application Priority Data

Dec. 14, 2012 (TW) ..... 101147574 A
Apr. 26, 2013 (TW) ..... 102115108 A

(51) Int. Cl.

| | |
|---|---|
| ***H01F 27/02*** | (2006.01) |
| ***H01F 5/00*** | (2006.01) |
| ***H01F 27/28*** | (2006.01) |
| ***H01F 27/30*** | (2006.01) |
| ***H01F 27/32*** | (2006.01) |
| ***H01F 41/04*** | (2006.01) |
| ***H01F 41/12*** | (2006.01) |

(52) U.S. Cl.

CPC ..... *H01F 27/30* (2013.01); *H01F 27/2847* (2013.01); *H01F 27/303* (2013.01); *H01F 27/323* (2013.01); *H01F 41/04* (2013.01); *H01F 41/122* (2013.01); *H01F 2027/2861* (2013.01); *Y10T 29/4902* (2015.01)

(58) Field of Classification Search

CPC ..... H01F 27/2823; H01F 27/2804; H01F 27/2871; H01F 27/306; H01F 30/16; H01F 27/30; H01F 27/2847; H01F 27/323; Y10T 29/4902

USPC ..... 336/180, 198, 223, 225

See application file for complete search history.

(56) References Cited

U.S. PATENT DOCUMENTS 5,495,213 A * 2/1996 Ikeda ..... 333/181
6,144,276 A * 11/2000 Booth ..... 336/61
6,269,531 B1 * 8/2001 Mercado ..... H01F 27/2847 29/602.1
6,445,272 B1 9/2002 Mercado et al.
(Continued)

FOREIGN PATENT DOCUMENTS

DE 10315539 A1 10/2004
DE 102005020689 B3 7/2006
(Continued)

*Primary Examiner* — Tsz Chan
*Assistant Examiner* — Kazi Hossain
(74) *Attorney, Agent, or Firm* — Cheng-Ju Chiang

(57) ABSTRACT

A coil has multiple coil sections connected to each other and each coil section includes a body portion and at least one direct or protrusive connecting portion disposed at one end of the body portion. Coil sections form at least one spiral path around the central axis of the coil, and on the projection of the coil along the central axis. The protrusive connecting portions protrude out of the path location of the direct connecting portions. Two connected coil sections form only one overlapped surface at the coupled parts of the direct or protrusive connecting portions. Regarding to the body portions in the same spiral path, a first end of one body portion is indirectly connected and disposed adjacent to a second end of another body portion. The second end has one surface with a virtual extension reaching the first end.

7 Claims, 16 Drawing Sheets

(56) References Cited

U.S. PATENT DOCUMENTS

| | | | | |
|---|---|---|---|---|
| 6,985,062 | B2 * | 1/2006 | Nakata et al. | 336/200 |
| 7,199,693 | B2 * | 4/2007 | Matsutani et al. | 336/200 |
| 7,216,451 | B1 * | 5/2007 | Troy | 42/72 |
| 7,414,510 | B1 * | 8/2008 | Cheng | H01F 27/2804 336/200 |
| 7,479,863 | B2 * | 1/2009 | Kit et al. | 336/200 |
| 2003/0016112 | A1 * | 1/2003 | Brocchi | H01F 27/2847 336/200 |
| 2003/0016113 | A1 * | 1/2003 | Brocchi | H01F 27/2847 336/200 |
| 2004/0070480 | A1 * | 4/2004 | Nakashima et al. | 336/200 |
| 2006/0269674 | A1 | 11/2006 | Schuster et al. | |
| 2008/0122569 | A1 * | 5/2008 | Ye et al. | 336/223 |
| 2008/0297297 | A1 * | 12/2008 | Lin | H01F 27/2847 336/107 |
| 2009/0045901 | A1 * | 2/2009 | Tsai et al. | 336/180 |
| 2010/0109831 | A1 * | 5/2010 | Podevels | H01F 27/2847 336/232 |
| 2010/0253465 | A1 * | 10/2010 | Yeh | H01F 27/2847 336/207 |
| 2011/0074397 | A1 * | 3/2011 | Bulumulla et al. | 324/127 |
| 2012/0086298 | A1 * | 4/2012 | Fubuki | H02K 3/18 310/208 |
| 2012/0206232 | A1 * | 8/2012 | Yamamoto | H01F 3/14 336/210 |
| 2012/0257420 | A1 * | 10/2012 | Kaneko | H01F 27/325 363/21.04 |

FOREIGN PATENT DOCUMENTS

| | | | | |
|---|---|---|---|---|
| EP | 0662699 | A1 | | 7/1995 |
| EP | 1271575 | A1 | | 1/2003 |
| JP | S52-103633 | A | | 8/1977 |
| JP | 59023510 | A | * | 2/1984 |
| JP | 7-263260 | A | | 10/1995 |
| JP | 2001-167930 | A | | 6/2001 |
| TW | 256924 | | | 9/1995 |

* cited by examiner

COIL AND MANUFACTURING METHOD THEREOF

CROSS REFERENCE TO RELATED APPLICATIONS

This Non-provisional application claims priority under 35 U.S.C. §119(a) on Patent Application No(s). 101147574 filed in Taiwan, Republic of China on Dec. 14, 2012, and 102115108 filed in Taiwan, Republic of China on Apr. 26, 2013, the entire contents of which are hereby incorporated by reference.

BACKGROUND OF THE INVENTION

Field of Invention

The present invention relates to a coil and, in particular, to a coil with high space factor.

Related Art

Inductance devices applied to electromagnets and transformers are mostly composed of coil, which is made by winding an enamel wire.

It is desired to provide a coil with low cost and high space factor (or space coefficient). The space factor is the ratio of the volume occupied by the wire in the winding to the total volume of the winding. The coil with higher space factor usually has smaller magnetic loss. Moreover, since the coil is the major component of a motor, the motor can be manufactured with smaller size, lighter weight and more powerful as the coil's space factor is increased. Besides, when applying to the high-frequency application, the skin effect of the coil current may cause some energy loss. The skin effect is the tendency of an alternating electric current (AC) to become distributed within a conductor such that the current density is largest near the surface of the conductor, and decreases with greater depths in the conductor. In this case, since the flat wire has larger surface area than the circular wire, using the flat wire to manufacture the high-frequency coil can effectively decrease the energy loss. Moreover, the flat wire also has a better heat-dissipation capability.

However, since the conventional coil is made by winding the enamel wire, it is hard to increase the space factor thereof. To fabricate a motor with small size and light weight, the performance of the motor will be decreased due to the low space factor of the coil. If the coil is made of a flat wire, it needs a special manufacturing process to form the coil as the flat surface of the flat wire is perpendicular to the central axis of the coil. Accordingly, the manufacturing cost of the coil by the flat wire is higher.

Therefore, it is an important subject of the present invention to provide a coil with low cost, high space factor and low energy loss, and moreover, to provide a coil made of a flat wire.

SUMMARY OF THE INVENTION

In view of the foregoing, an objective of the present invention is to provide a coil with high space factor and, moreover, to provide a flat coil with high space factor.

To achieve the above objective, the present invention discloses a coil having a plurality of coil sections connected to each other. Each coil section comprises a body portion and at least one connecting portion disposed at one end of the body portion and connected with another coil section. The coil sections form at least one spiral path around the central axis of the coil, and two connected coil sections form only one overlapped surface at the coupled parts of the connecting portions. Regarding to the body portions in the same spiral path, a first end of one of the body portions is indirectly connected and disposed adjacent to a second end of another one of the body portions, hereby "indirectly connected" means they are connected, especially electrically connected, through at least one connecting portion. Along the spiral path, the second end has one surface with a virtual extension reaching the first end.

In one embodiment, along the spiral path there are one surface of the first end and one surface of the second end substantially located on the same plane, or along the spiral path the second end has one surface with a virtual extension located between two surfaces of the first end, or along the spiral path the second end has one surface with a virtual extension penetrating through one surface of the first end.

In one embodiment, the coil sections are connected by electroplating or welding.

In one embodiment, the coil sections are formed by pressing a metal sheet so as to form the connected coil sections, and then the connecting portions are folded to form the coil.

In one embodiment, at least one of the coil sections has different width and/or different thickness.

To achieve the above objective, the present invention also discloses a coil having a plurality of coil sections connected to each other. Each coil section comprises a body portion and at least one direct connecting portion or at least one protrusive connecting portion disposed at one end of the body portion and connecting with another coil section. The direct connecting portions or protrusive connecting portions are folded or connected by welding, so that the coil sections form at least one spiral path around the central axis of the coil. And on the projection of the coil along the central axis, the protrusive connecting portions protrude out of the path at the location of the direct connecting portions, and two connected coil sections form only one overlapped surface at the coupled parts of the direct connecting portions or the protrusive connecting portions.

In one embodiment, regarding to the body portions in the same spiral path, a first end of one of the body portions is indirectly connected and disposed adjacent to a second end of another one of the body portions, along the spiral path the second end has one surface with a virtual extension reaching the first end, along the spiral path one surface of the first end and one surface of the second end are substantially located on the same plane, or along the spiral path the second end has one surface with a virtual extension located between two surfaces of the first end, or along the spiral path the second end has one surface with a virtual extension penetrating through one surface of the first end.

In one embodiment, the coil sections are formed by pressing a metal sheet so as to form the connected coil sections, and then the direct connecting portions and the protrusive connecting portions are folded for once to form the coil.

In one embodiment, the coil sections are divided into two groups, each group of the coil sections is formed by pressing a metal sheet, the coupled parts of the direct connecting portions and the protrusive connecting portions are folded for once, and then the two groups of the coil sections are intertwined to form the coil.

In one embodiment, the coil sections are connected by electroplating or welding.

In one embodiment, at least one of the coil sections has different width and/or different thickness.

To achieve the above objective, the present invention further discloses a manufacturing method of a coil, comprising the steps of: pressing a metal sheet to form a plurality of coil sections; dispensing a glue on at least one surface of each of the coil sections; providing a plurality of insulation beads in the glue; and overlapping the coil sections by folding, or connecting the coil sections by electroplating or welding so as to form a multilayer insulation structure, wherein layers of the multilayer insulation structure are separated by the insulation beads.

In one embodiment, each of the coil sections comprises a body portion and at least one connecting portion disposed at one end of the body portion and connecting with another one of the coil sections, the overlapped coil sections form at least one spiral path around the central axis of the coil, and two connected coil sections form only one overlapped surface at the coupled parts of the connecting portions.

As mentioned above, the present invention fabricates a plurality of coil sections by pressing or cutting a metal sheet, and then electroplates, welds or folds the coil sections to form a coil. Compared with the conventional manufacturing method of the edge-wound coil, the manufacturing method of the invention is simpler and faster, so that the manufacturing cost can be decreased. Besides, the present invention can improve the space factor of the coil and can be applied to the flat wire for decreasing the skin effect, speeding the heat dissipation of the coil, and making the structure of the coil more solid and more uniform in thickness.

BRIEF DESCRIPTION OF THE DRAWINGS

The invention will become more fully understood from the detailed description and accompanying drawings, which are given for illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1A:
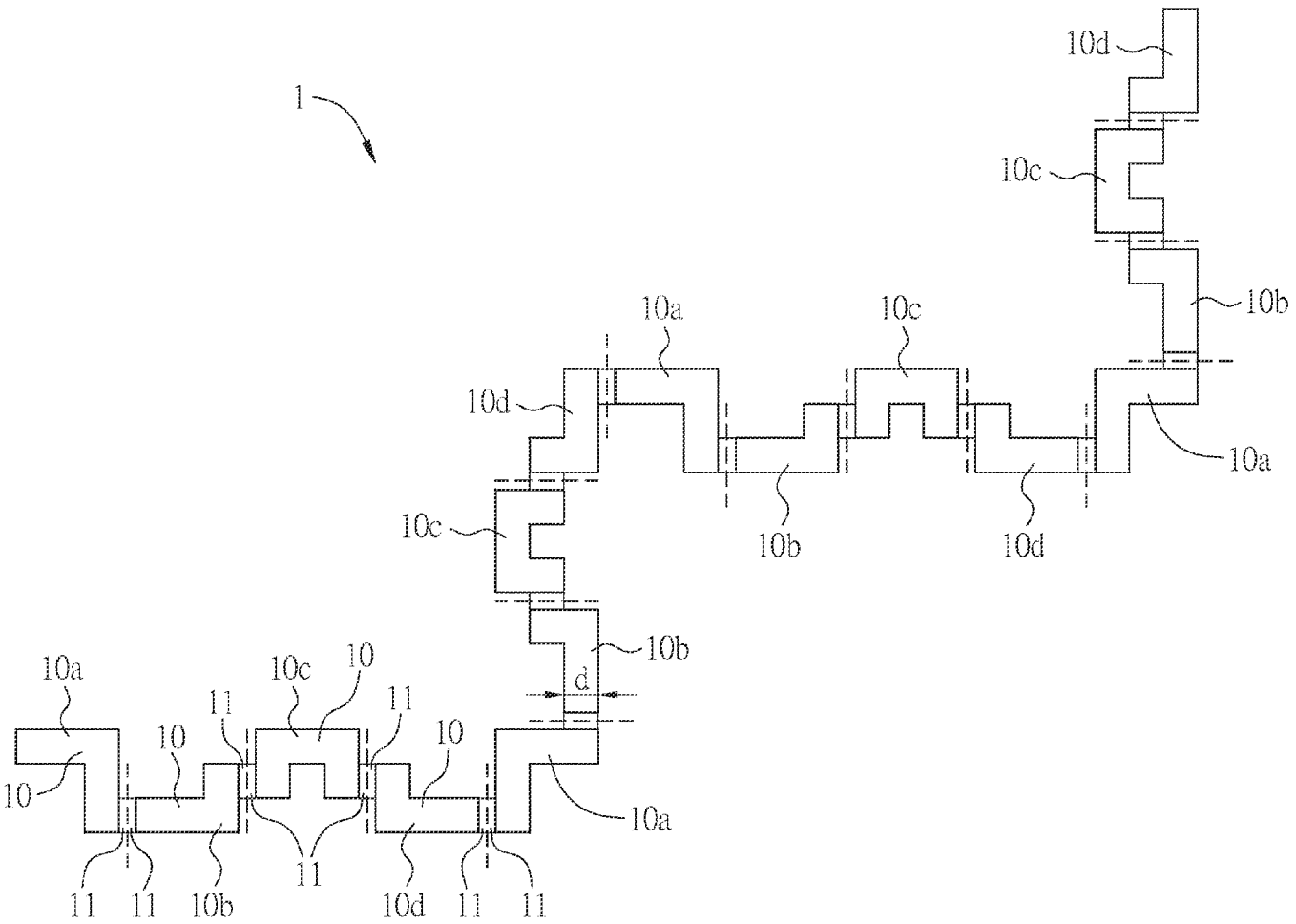
FIG. 1A is a schematic diagram showing a coil according to a first embodiment of the invention.
Figure 1B:
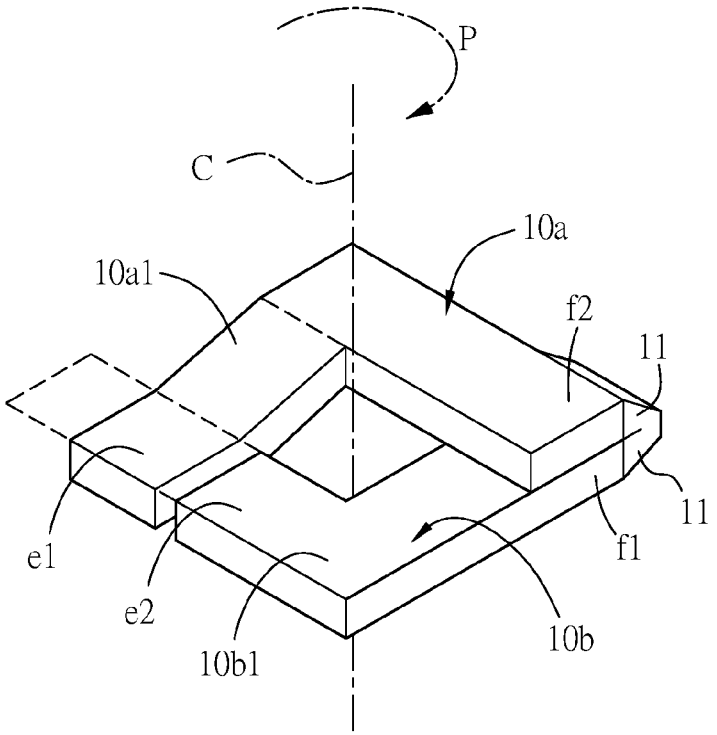
FIG. 1B is a perspective view of a part of a stacked coil of FIG. 1A.
Figure 1C:
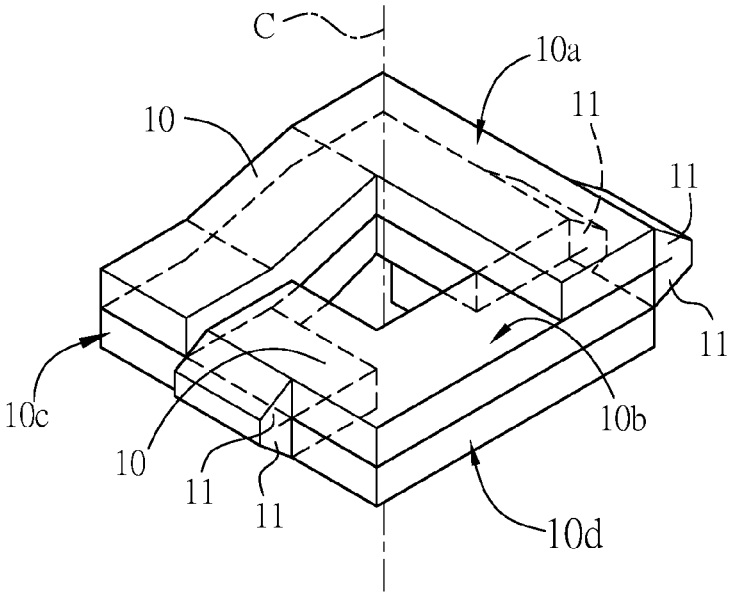
FIG. 1C is another perspective view of a part of a stacked coil of FIG. 1A.
Figure 1D:
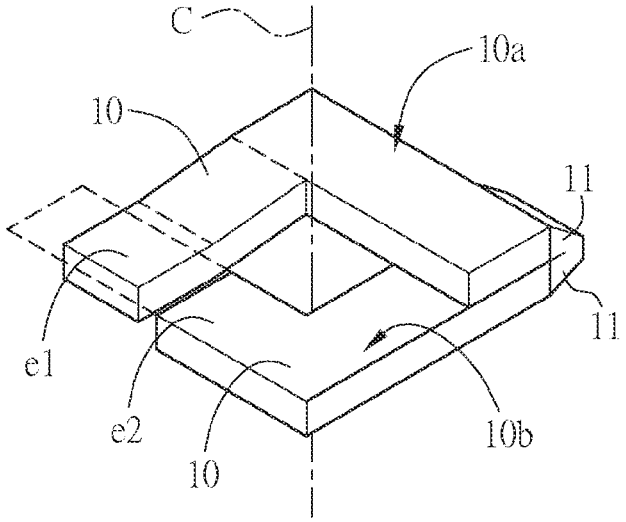
FIG. 1D is a perspective view of a variation of a part of a stacked coil of FIG. 1A.
Figure 1E:
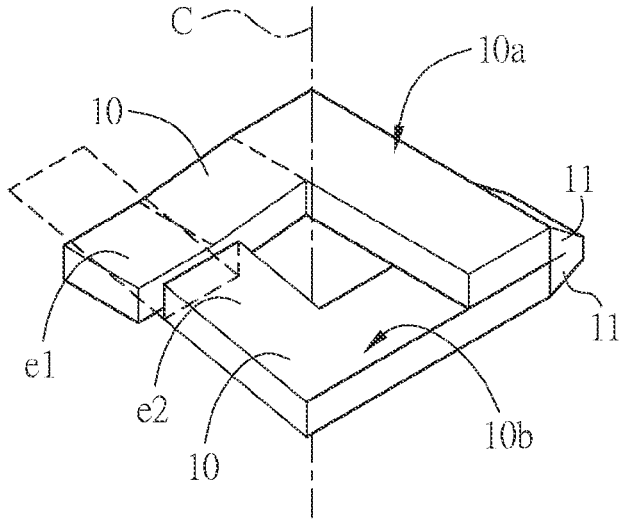
FIG. 1E is another perspective view of a variation of a part of a stacked coil of FIG. 1A.
Figure 1F:
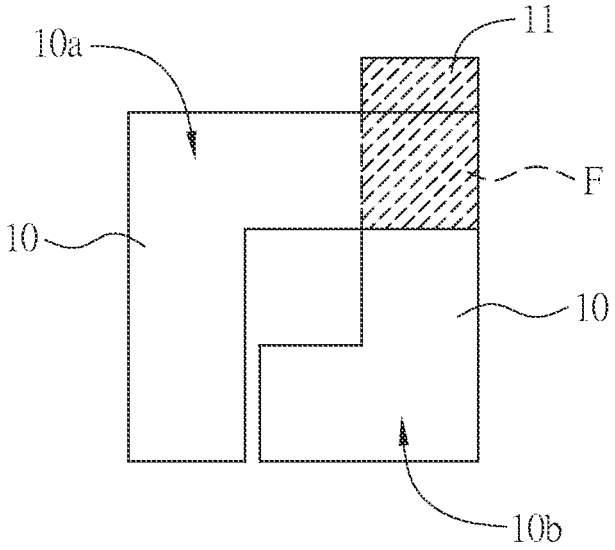
FIG. 1F is a top view of the coil of FIG. 1A.

FIG. 1A is a schematic diagram showing a coil according to a first embodiment of the invention, FIG. 1B is a perspective view of a part of a stacked coil of FIG. 1A, FIG. 1C is another perspective view of a part of a stacked coil of FIG. 1A, FIG. 1D is a perspective view of a variation of a part of a stacked coil of FIG. 1A, FIG. 1E is another perspective view of a variation of a part of a stacked coil of FIG. 1A, and FIG. 1F is a top view of the coil of FIG. 1A.

Referring to FIGS. 1A to 1F, a coil 1 includes a plurality of continuous coil sections 10*a*-10*d*, which are made by pressing a single metal sheet. The width d of the coil sections 10*a*-10*d* is, for example but not limited to, 1 cm. Each of the coil sections 10*a*-10*d* has a body portion 10 and at least one connecting portion 11. The connecting portion(s) 11 is disposed at one end or two ends of the body portion 10. Different body portions 10 and different connecting portions 11 may have different shapes. From the left bottom to right bottom, FIG. 1A shows four coil sections 10*a*-10*d*, which are connected with each other. The coil section 10*a* has a connecting portion 11, the coil section 10*b* has two connecting portions 11, the coil section 10*c* has two connecting portions 11, and the coil section 10*d* has two connecting portions 11. The connecting portion 11 of the coil section 10*a* is folded along the dotted line onto the connecting portion 11 of the coil section 10*b*. The connecting portion 11 of the coil section 10*b* is folded along the dotted line onto the connecting portion 11 of the coil section 10*c*. The connecting portion 11 of the coil section 10*c* is folded along the dotted line onto the connecting portion 11 of the coil section 10*d*. Finally, the coil sections 10*a*-10*d* form at least one spiral path around the central axis C of the coil 1. When stacking two groups of coil sections 10*a*-10*d*, the connecting portion 11 of the coil section 10*d* in a first group is folded along the dotted line onto the connection portion 11 of the coil section 10*a* in the second group. Then, the residual coil sections 10*b*-10*d* in the second group are stacked thereon by folding the connection portions 11.

To clarify the feature of the connecting portion 11, FIG. 1B only shows the coil sections 10*a* and 10*b*. Taking the coil sections 10*a* and 10*b* as an example, after folding the connecting portion 11 along the dotted line, the top half of the coupled part is the connecting portion 11 of the coil section 10*a*, while the bottom half of the coupled part is the connecting portion 11 of the coil section 10*b*. Accordingly, the coil sections 10*a* and 10*b* together form a spiral path around the central axis C of the coil 1, and the coupled part of the connecting portions 11 forms only one overlapped surface F with a two-layer thickness. To be noted, the overlapped surface F is constructed by folding the connected coil sections for once instead of folding them for multiple times. Besides, the overlapped areas of the connecting portions 11 of different coil sections are not limited to a rectangle. For example, the coupled parts of the connecting portions 11 may have at least one fork structure, and two ends of the fork structure may be connected with the connecting portions of adjacent coil sections, respectively. In this case, the connecting portions 11 are also overlapped at an overlapped surface F. Moreover, the body portion 10 may also have at least one fork structure, so that the entire coil may contain a plurality of coils connected in parallel.

The body portions 10*a*1 and 10*b*1 of the coil sections 10*a* and 10*b* are located on the same spiral path. The body portion 10*a*1 has a first end e1 and a second end f2, and the other body portion 10*b*1 has a first end f1 and a second end e2. The first end e1 and the second end e2 are indirectly connected and disposed adjacent to each other. Along the spiral path the second end e2 has one surface with a virtual extension reaching the first end e1. The coil sections 10*a* and 10*b* are connected around the central axis C to form a basic unit of the spiral path. As shown in FIG. 1B, the coil sections 10*a* and 10*b* are configured at a single wind (or turn) or on the same layer of the spiral path. When viewed along a path P of one turn, the body portion 10*a*1 can be referred to as a preceding body portion of the turn, and the body portion 10*b*1 can be referred to as the succeeding body portion of the turn. Therefore, the first end f1 of the body portion 10*b*1 is connected to the connecting portion 11 disposed at the second end f2 of the body portion 10*a*1 (i.e. the preceding body portion), and the bottom surface at the second end f2 of the body portion 10*a*1 is overlapped with the top surface at the first end f1 of the body portion 10*b*1 (i.e. the succeeding body portion). Referring to FIG. 1C, the coil sections 10*a* and 10*b* are connected to form a single wind (or a basic unit of the spiral path), and the coil sections 10*c* and 10*d* are connected to form another single wind (or another basic unit of the spiral path). In this embodiment, a basic unit of the spiral path is composed of two coil sections. Of course, a basic unit of the spiral path can be composed of two or more coil sections, which will be described with reference to the following drawings.

Please refer to FIGS. 1B, 1D and 1E. In this embodiment, the coil sections 10*a* and 10*b* are flat, and the surfaces of the coil sections 10*a* include the top surfaces and the bottom surfaces thereof. As shown in the figures, the second end e2 has one surface (top surface) with a virtual extension (defined by the dotted lines) reaching the first end e1 along the spiral path. One surface of the first end e1 and one surface of the second end e2 are substantially located at the same plane. Referring to FIG. 1B, the top surface of the first end e1 and the top surface of the second end e2 are located at the same plane. As shown in FIG. 1D, along the spiral path one surface (top surface) of the second end e2 has a virtual extension located between two surfaces of the first end e1. As shown in FIG. 1E, along the spiral path one surface (bottom surface) of the second end e2 has a virtual extension penetrating through one surface (top surface) of the first end e1. To be noted, the virtual extension is not a real existing surface.

Figure 1G:
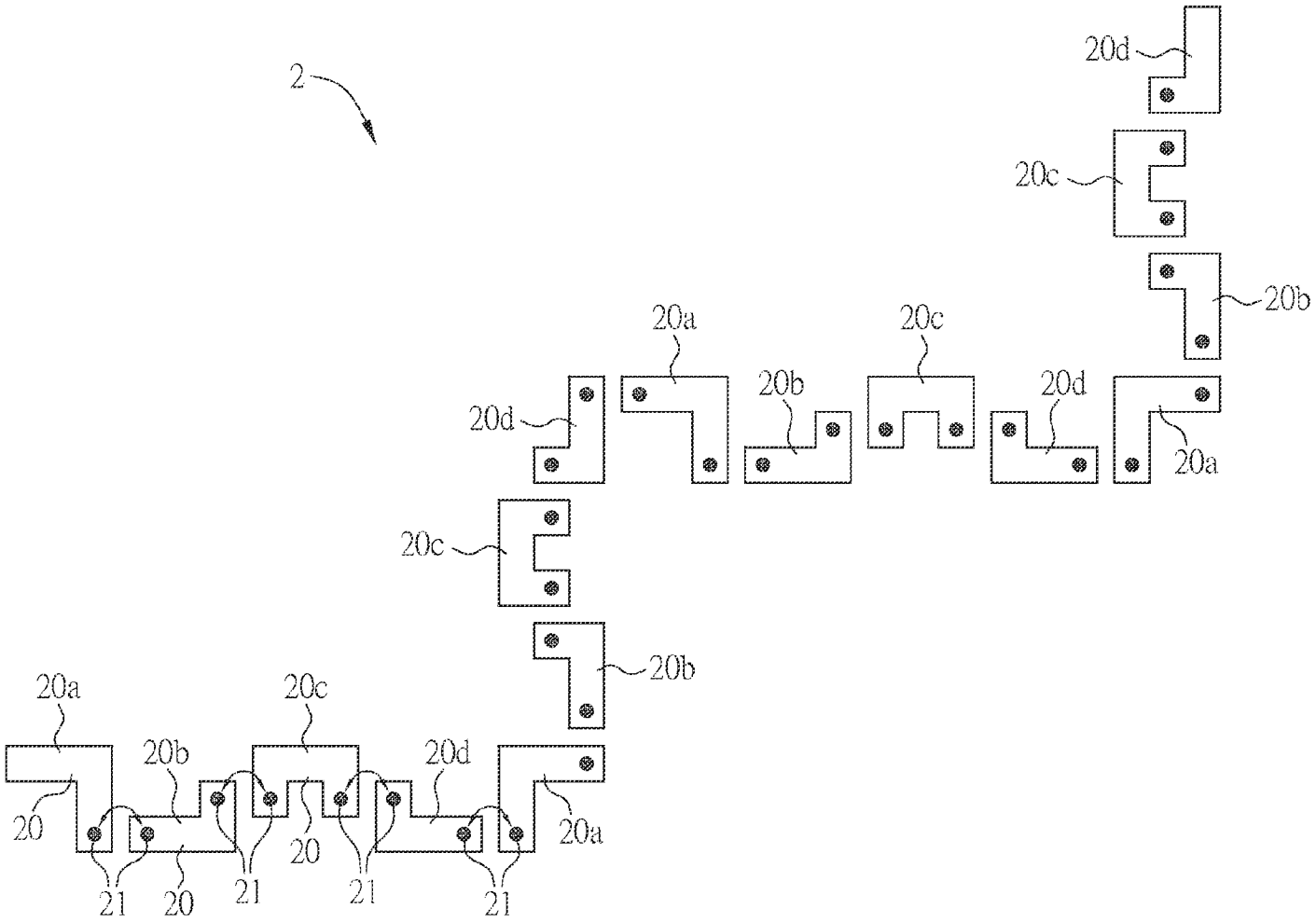
FIG. 1G is a schematic diagram showing another welded coil according to the first embodiment of the invention.
Figure 1H:
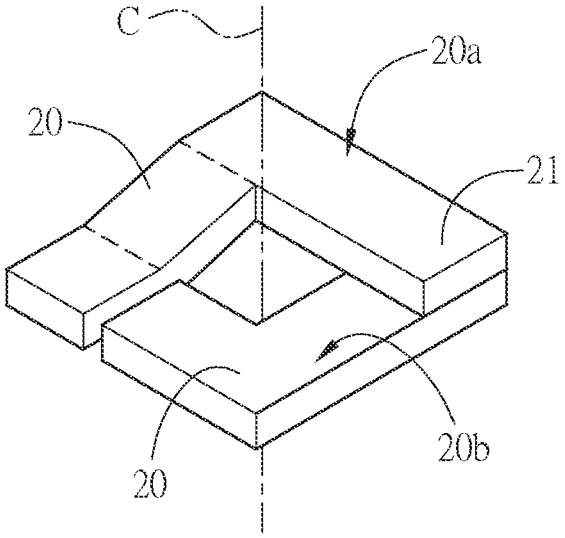
FIG. 1H is a perspective view of a part of a stacked coil of FIG. 1G.

FIG. 1G is a schematic diagram showing another welded coil according to the first embodiment of the invention, and FIG. 1H is a perspective view of a part of a stacked coil of FIG. 1G.

Referring to FIGS. 1G and 1H, the coil 2 includes a plurality of separated coil sections, such as four separated coil sections 20*a*-20*d*, which are made by pressing a single metal sheet. The width d of the coil sections 20*a*-20*d* is, for example but not limited to, 1 cm. Each of the coil sections 20*a*-20*d* has a body portion 20 and at least one connecting portion 21. The connecting portion(s) 21 is disposed at one end or two ends of the body portion 20. Different from the previous aspect, the connecting portions 21 of the coil sections 20*a*-20*d* of the coil 2 are all disposed inside the body portion 20 and each have a welding point (see the dot in the figures) for connecting to the connecting portion 21 of the adjacent coil section by welding or electroplating. In this aspect, the connecting portion 21 of the coil section 20*a* is welded on top of the connecting portion 21 of the coil section 20*b*, the connecting portion 21 of the coil section 20*b* is welded on top of the connecting portion 21 of the coil section 20*c*, and the connecting portion 21 of the coil section 20*c* is welded on top of the connecting portion 21 of the coil section 20*d*. After connecting and stacking the coil sections 20*a*-20*d* by welding or electroplating, a part of the stacked coil sections as shown in FIG. 1H can be manufactured.

Figure 1I:
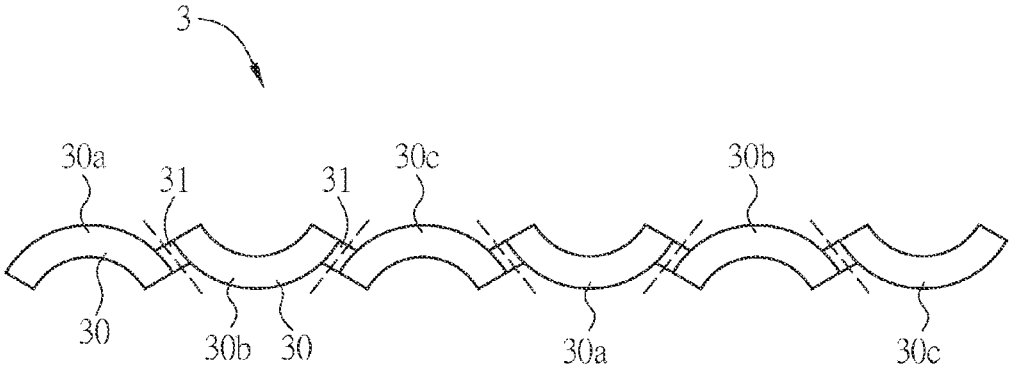
FIG. 1I is a schematic diagram showing another coil according to the first embodiment of the invention.
Figure 1J:
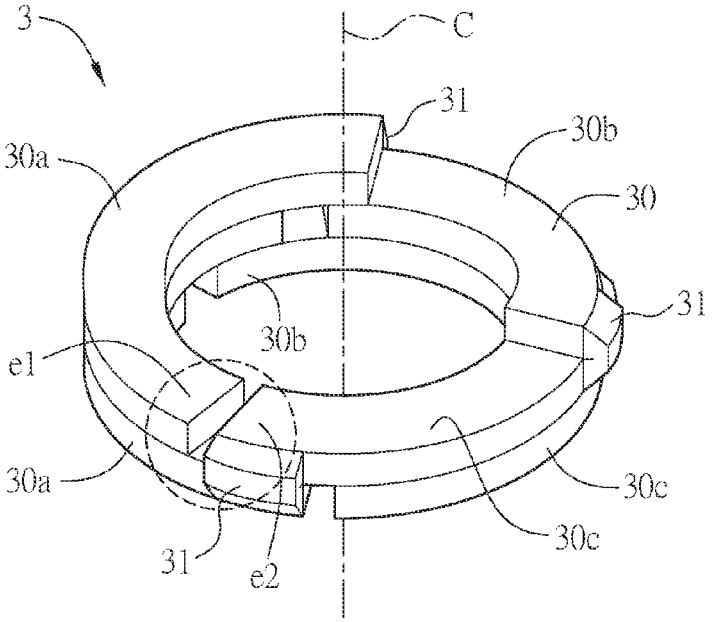
FIG. 1J is a perspective view of a part of a stacked coil of FIG. 1I.

FIG. 1I is a schematic diagram showing another coil according to the first embodiment of the invention, and FIG. 1J is a perspective view of a part of a stacked coil of FIG. 1I.

Referring to FIGS. 1I and 1J, the coil 3 includes a plurality of continuous coil sections 30*a*, 30*b* and 30*c*, which are made by pressing a single metal sheet. Each of the coil sections 30*a*-30*c* has an arc shape and includes a body portion 30 and at least one connecting portion 31. The connecting portion(s) 31 is disposed at one end or two ends of the body portion 30. Besides, as shown in FIG. 1J, one wind (a basic unit of the spiral path) of the coil 3 is composed of three coil sections 30*a*, 30*b* and 30*c*, which is different from the previous aspects. The indirectly connected ends of the coil sections 30*a* and 30*b* are located at different planes, and the indirectly connected ends of the coil sections 30*b* and 30*c* are also located at different planes. The second end e2 of the body portion 30 of the coil section 30*c* and the first end e1 of the body portion 30 of the coil section 30*a* are disposed adjacent to each other and indirectly connected. Along the spiral path the top surface of the second end e2 has a virtual extension reaching the first end e1, and the top surfaces of the first end e1 and the second end e2 are substantially located at the same plane (see the dotted circle). Accordingly, the connected two coil sections are not necessarily to be the two coil sections that have their ends substantially located at the same plane. That is, the connected coil sections 30*a* and 30*b* or the connected coil sections 30*b* and 30*c* form a single overlapped surface at the coupled parts of the connecting portions 31, and the indirectly connected ends (e1 and e2) of the body portions 30 of the two adjacent coil sections 30*a* and 30*c* are substantially located at the same plane. In practice, along the spiral path one surface of the first end e1 and one surface of the second end e2 can be substantially located on the same plane, or along the spiral path the second end e2 has one surface with a virtual extension located between two surfaces of the first end e1, or along the spiral path the second end e2 has one surface with a virtual extension penetrating through one surface of the first end e1.

As mentioned above, the coil is manufactured by pressing a metal sheet and then folding or welding/electroplating the coil sections. This manufacturing method is simple and suit for mass production, and the manufacturing cost of the coil is much lower than the conventional winding coil. Moreover, the coil of the embodiment is flat, so that it can provide higher space factor, lower skin effect and better heat dissipation.

To be noted, the numbers of the coil sections in the coils 1, 2 and 3 can be adjusted according to the requirements of the products. Similarly, the width d and thickness of the coil sections can be different according to the requirements of the products. For reducing the skin effect, the area or perimeter of the cross-section of each coil section is substantially remained the same so as to prevent the undesired loss.

Figure 2A:
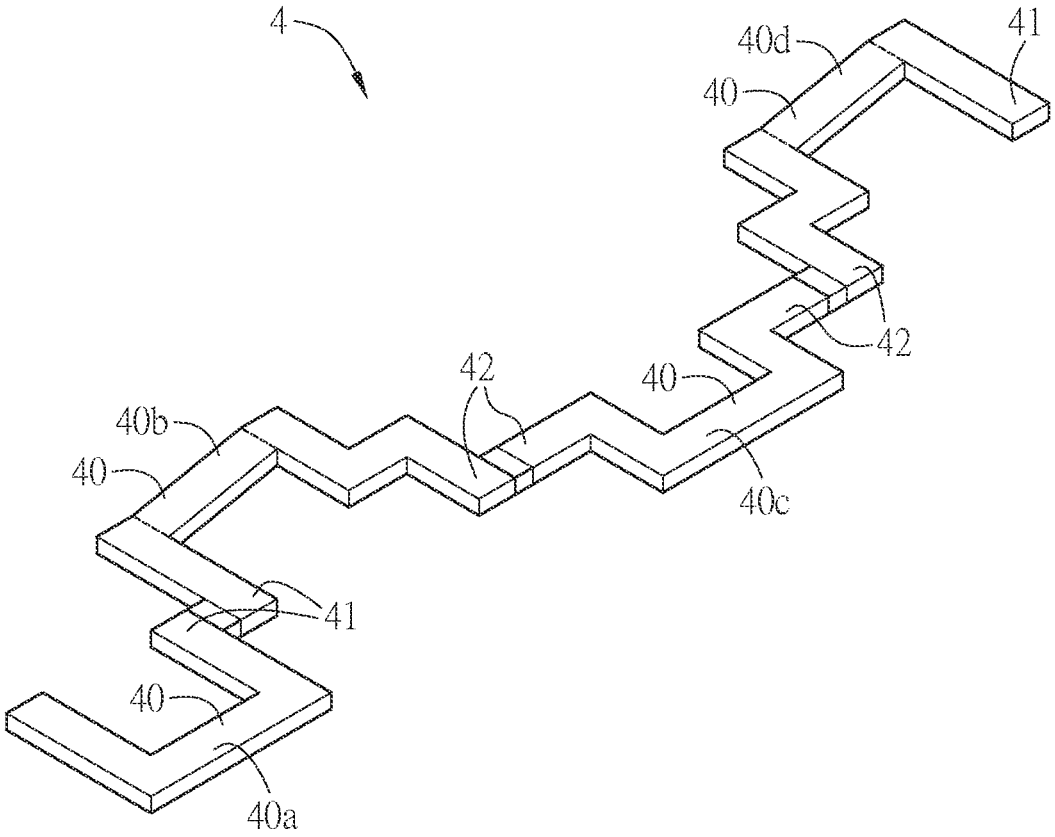
FIG. 2A is a schematic diagram showing a coil according to a second embodiment of the invention.
Figure 2B:
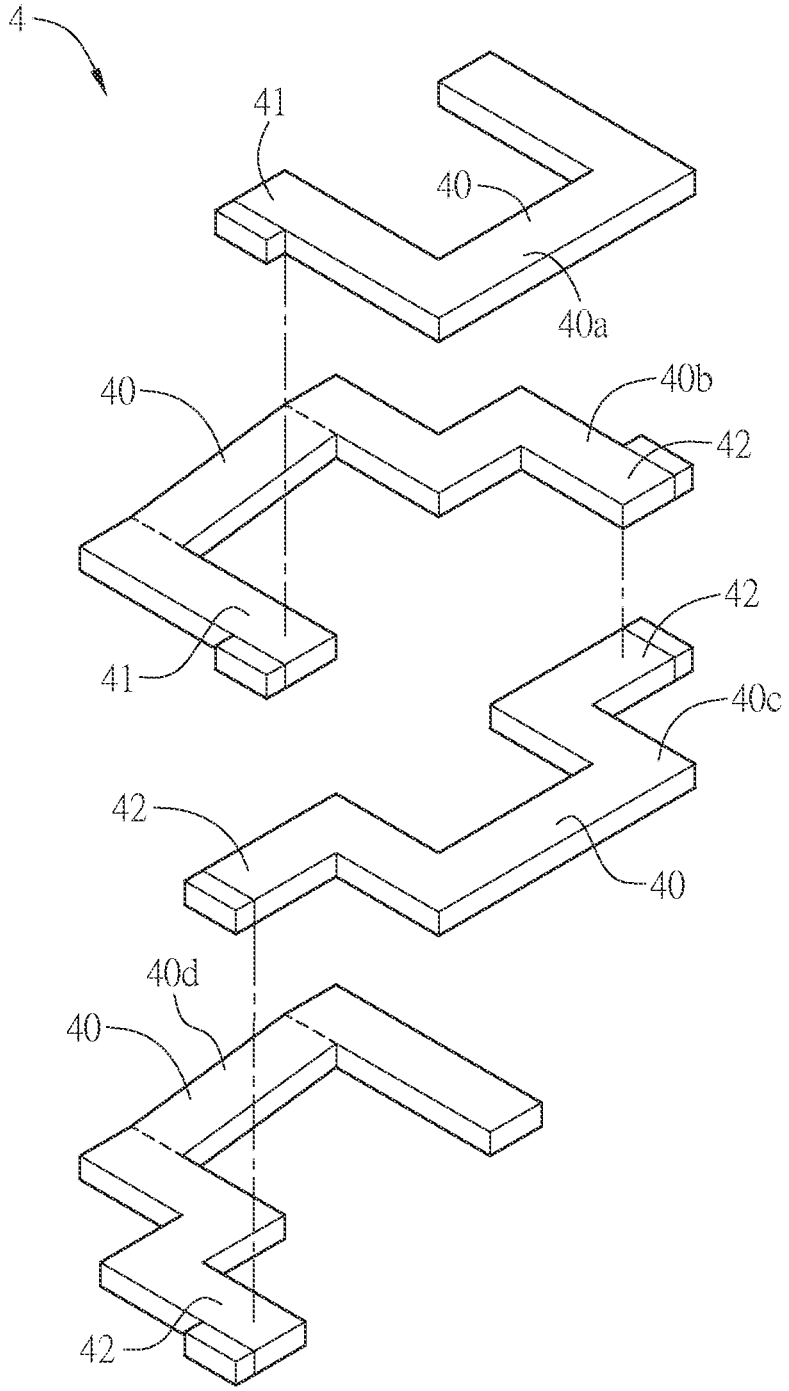
FIG. 2B is an exploded view of the coil of FIG. 2A.

FIG. 2A is a schematic diagram showing a coil according to a second embodiment of the invention, and FIG. 2B is an exploded view of the coil of FIG. 2A.

Referring to FIGS. 2A and 2B, the coil 4 includes a plurality of continuous coil sections, such as four continuous coil sections 40*a*-40*d*, which are made by pressing a single metal sheet. The shapes of the coil sections 40*a*-40*d* are totally different, and the width d of the coil sections 20*a*-20*d* is, for example but not limited to, 1 cm. Each of the coil sections 40*a*-40*d* has a body portion 40 and a direct connecting portion 41 or a protrusive connecting portion 42. The direct connecting portion 41 or the protrusive connecting portion 42 is disposed at one end or two ends of the body portion 40. As shown in FIG. 2B, the coil section 40*a* has a direct connecting portion 41, the coil section 40*b* has a direct connecting portion 41 and a protrusive connecting portion 42, the coil section 40*c* has two protrusive connecting portions 42, and the coil section 40*d* has a protrusive connecting portion 42. The protrusive connecting portions 42 protrude out at the path location of the direct connecting portions 41, and two connected coil sections form only one overlapped surface at the coupled parts of the direct connecting portions 41 or the protrusive connecting portions 42.

Figure 2C:
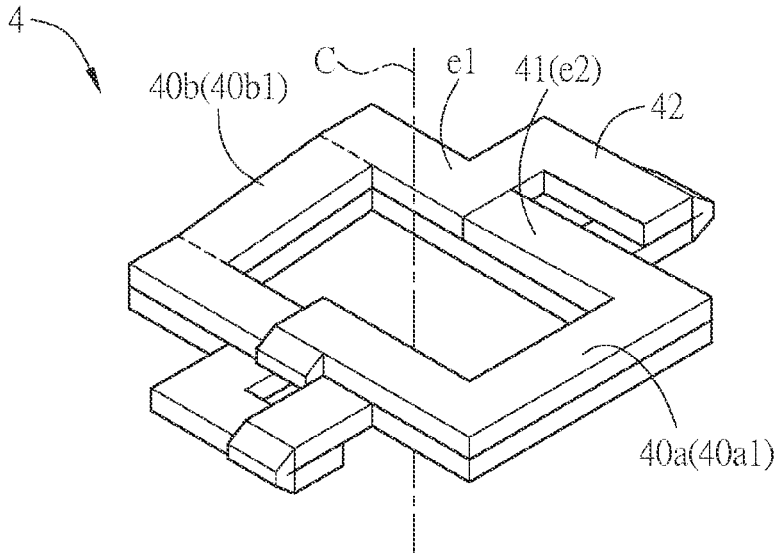
FIG. 2C is perspective view of a stacked coil of FIG. 2A.

In this embodiment, the body portions 40 of the coil sections 40*a*-40*d* are substantially U-shaped. As shown in FIG. 2C, the coil sections 40*a* and 40*b* form a wind (a basic unit of the spiral path). Regarding to the body portions of the coil sections 40*a* and 40*b*, the first end e1 of the body portion of the coil section 40*b* and the second end e2 of the body portion of the coil section 40*a* are disposed adjacent to each other and are indirectly connected. Besides, along the spiral path the top surface of the second end e2 has a virtual extension reaching the first end e1. As shown in the figures, the virtual extension of the top surface of the second end e2 and the first end e1 are substantially located at the same plane. In practice, except for the above configuration, along the spiral path one surface of the second end e2 may have a virtual extension located between two surfaces of the first end e1, or along the spiral path one surface of the second end e2 may have a virtual extension penetrating through one surface of the first end e1. To be noted, the second end e2 is directly disposed on the direct connecting portion 41 and is also a part of the body portion 40*a*1. The first end e1 is disposed on the body portion 40*b*1, and the protrusive connecting portion 42 is connected with the first end e1 of the body portion 40*b*1.

Figure 2D:
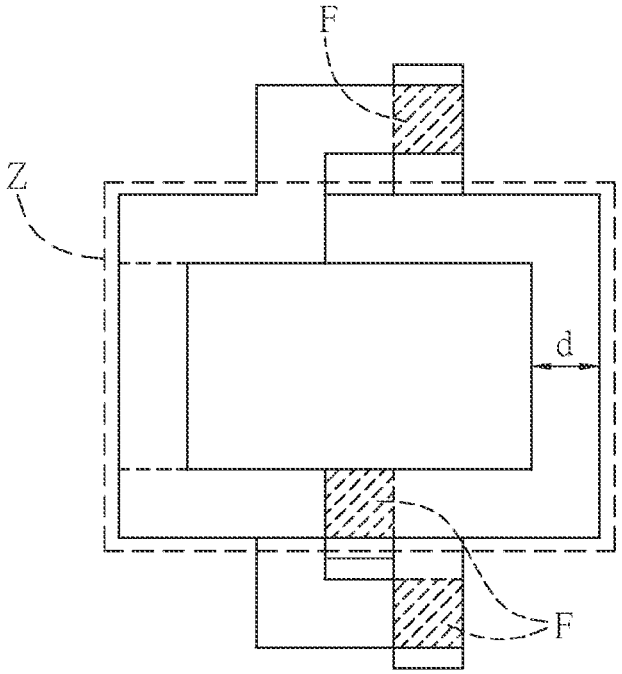
FIG. 2D is a top view of the coil of FIG. 2C.

FIG. 2C is a perspective view of a stacked coil of FIG. 2A, and FIG. 2D is a top view of the coil of FIG. 2C.

Referring to FIGS. 2A to 2D, the direct connecting portion 41 of the coil section 40*a* is folded onto the direct connecting portion 41 of the coil section 40*b*. The protrusive connecting portion 42 of the coil section 40*b* is folded onto one of the protrusive connecting portions 42 of the coil section 40*c*. The other protrusive connecting portion 42 of the coil section 40*c* is folded onto the protrusive connecting portion 42 of the coil section 40*d*. Finally, the coil sections 40*a*-40*d* form a spiral path around the central axis C of the coil 4. In addition, a part of the body portion 40 of the coil section 40*b* (the middle part) is formed with an oblique surface, so that the top surface of the body portion 40 of the coil section 40*b* is gradually rising from the bottom surface of the body portion 40 of the coil section 40*a* to the top surface of the body portion 40 of the coil section 40*a*. That is, the top surface of the body portion 40 of the coil section 40*b* obliquely extends across one layer's height. Similarly, the top surface of the body portion 40 of the coil section 40*d* is gradually rising from below the bottom surface of the body portion 40 of the coil section 40*c* to the top surface of the body portion 40 of the coil section 40*c*. The coil 4 can be manufactured by stacking the coil sections 40*a*-40*d* as shown in FIGS. 2C and 2D, wherein the coil sections 40*a*-40*d* are tightly stacked.

In the above aspect, only the coil sections 40*b* and 40*d* have the oblique surfaces. In practice, the other coil sections 40*a* and 40*c* may also have the oblique surfaces. The four coil sections 40*a*-40*d* are folded to form a structure containing the protrusive connecting portions 42 and a rectangular main coil zone Z (see dotted block in FIG. 2D surrounding the central axis C), which is composed of the main bodies 40 and the direct connecting portions 41. The protrusive connecting portions 42 protrude out at the path location of the direct connecting portions 41. That is, the protrusive connecting portions 42 protrude out of the main coil zone Z. Two connected coil sections form only one overlapped surface F (see the dotted-line area in FIG. 2D) at the coupled parts of the direct connecting portions 41 or the protrusive connecting portions 42. To be noted, the overlapped surface F is constructed by folding the adjacent coil sections for once instead of folding them for multiple times, so the folded area has a minimum height of two layers. Besides, the overlapped areas of the direct connecting portions 41 or the protrusive connecting portions 42 are not limited to a rectangle. The coupled parts of the direct connecting portions 41 or the protrusive connecting portions 42 may have at least one divided structure. For example, the direct connecting portions 41 have a divided structure. Two ends of the divided structure may be connected with the divided body portion 40 and the divided protrusive connecting portion 42. In this aspect, the direct connecting portions 41 or the protrusive connecting portions 42 are still connected at an overlapped surface F, so that the entire coil 4 may contain a plurality of coils connected in parallel.

Figure 2E:
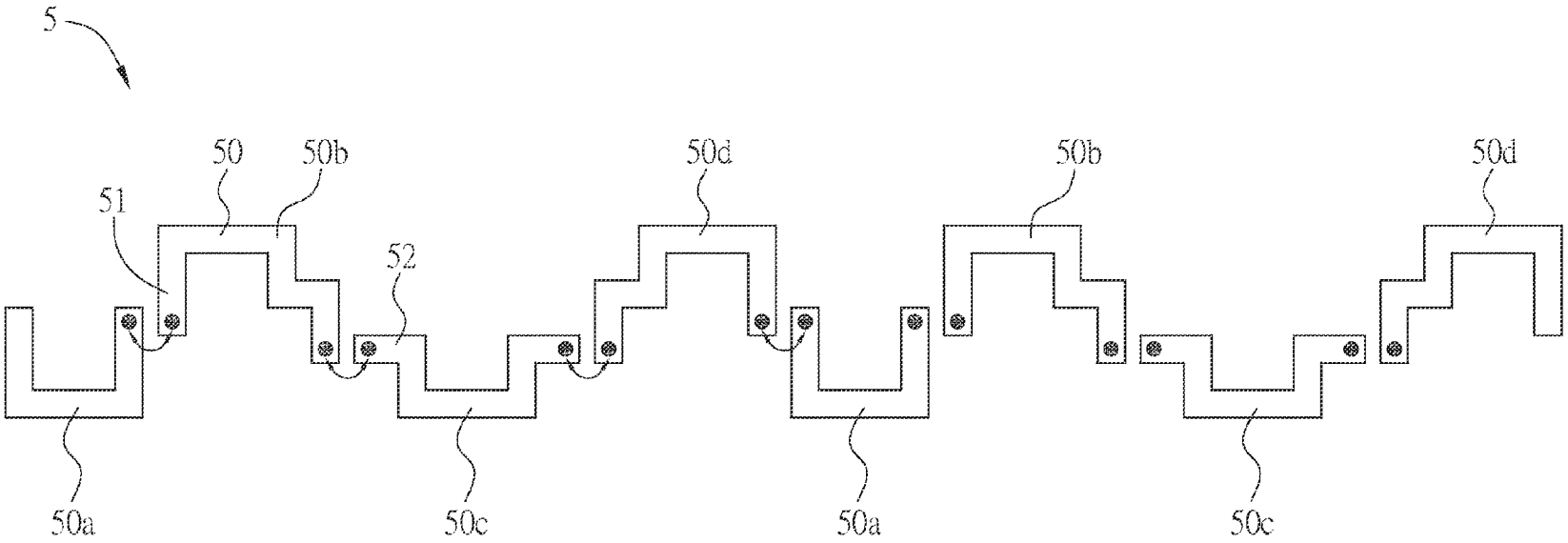
FIG. 2E is a schematic diagram showing another welded coil according to the second embodiment of the invention.

FIG. 2E is a schematic diagram showing another welded coil according to the second embodiment of the invention. Referring to FIG. 2E, the coil 5 includes separated two groups of coil sections 50*a*-50*d* (totally 8 coil sections). The direct connecting portion 51 of the coil section 50*a* is welded onto the direct connecting portion 51 of the coil section 50*b*, the protrusive connecting portion 52 of the coil section 50*b* is welded onto one of the protrusive connecting portions 52 of the coil section 50*c*, and the other protrusive connecting portion 52 of the coil section 50*c* is welded onto the protrusive connecting portion 52 of the coil section 50*d*. The welding method is disclosed in the first embodiment, so the detailed description thereof will be omitted here. The welding aspect is repeated to connect the 8 coil sections 50*a*-50*d*. In practice, the number of the coil sections may be various depending on the requirements of the products, and this invention is not limited. Besides, the coil sections can also be connected by folding or electroplating.

Figure 3A:
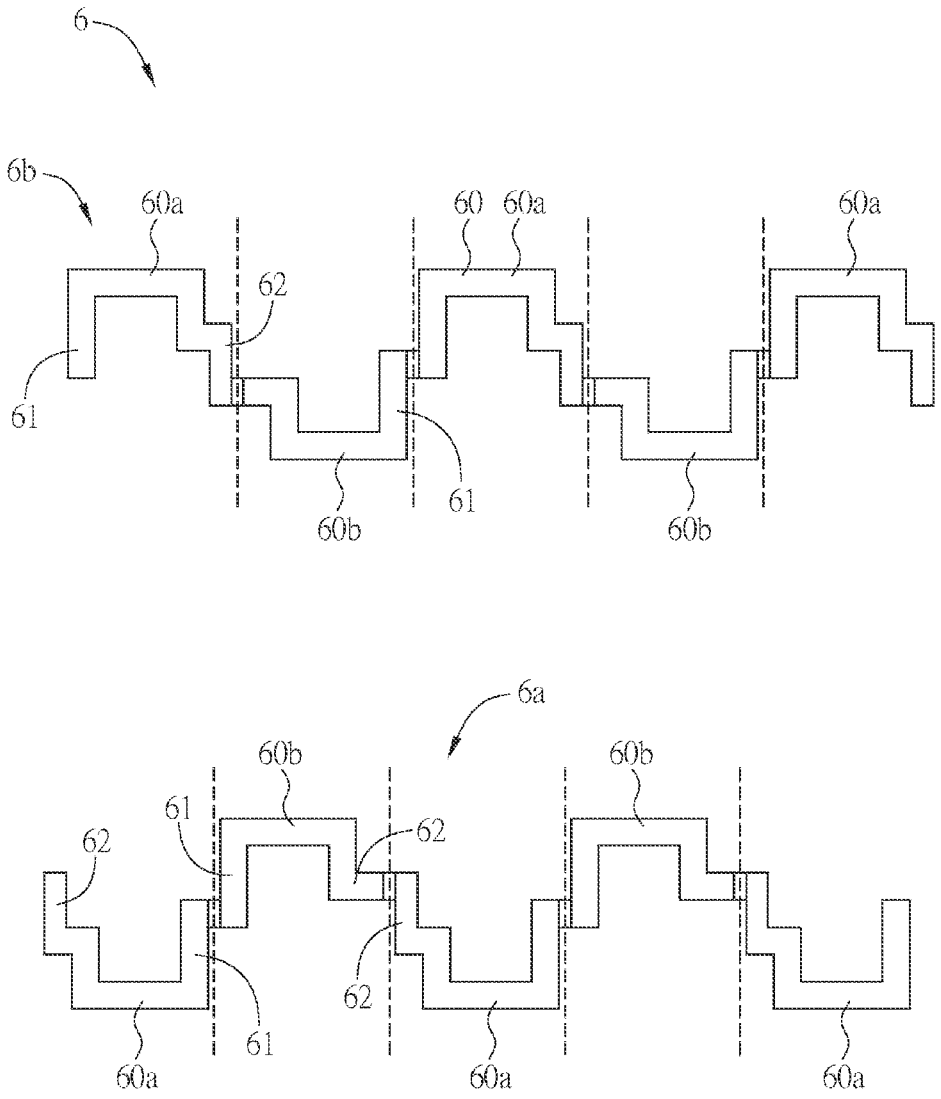
FIG. 3A is a schematic diagram showing a coil according to a third embodiment of the invention.
Figure 3B:
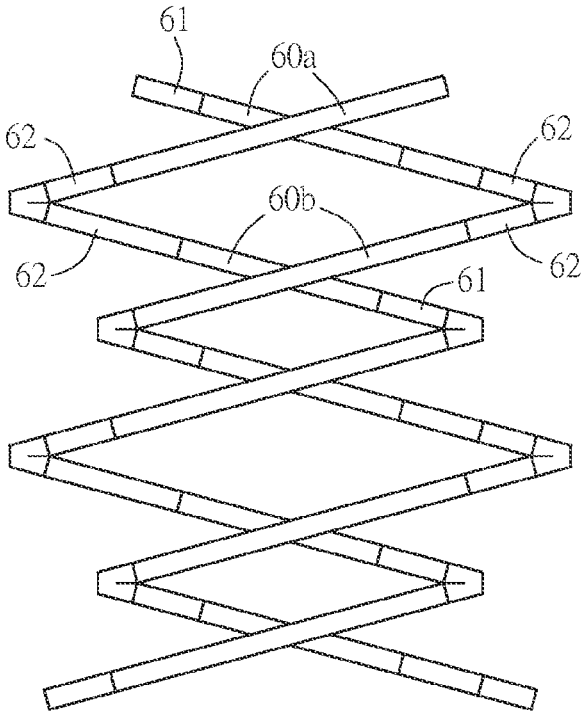
FIG. 3B is a schematic diagram showing a wound coil of FIG. 3A.
Figure 3C:
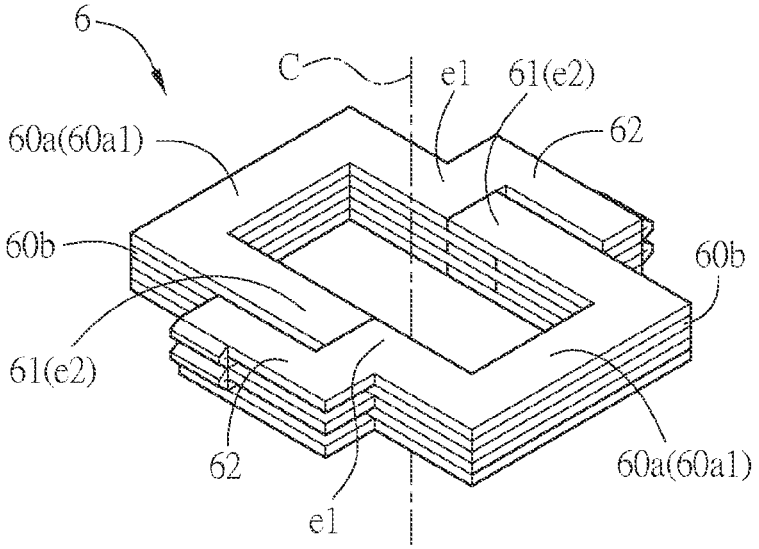
FIG. 3C is a perspective view of a stacked coil of FIG. 3A.
Figure 3D:
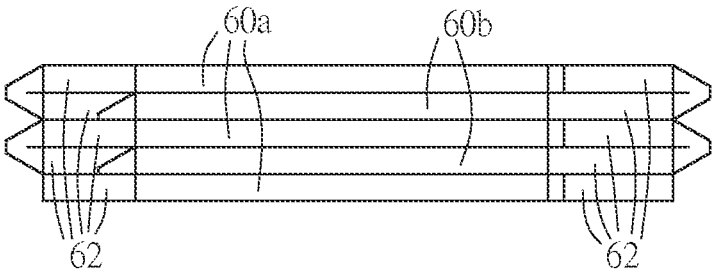
FIG. 3D is a side view of the coil of FIG. 3C.
Figure 3E:
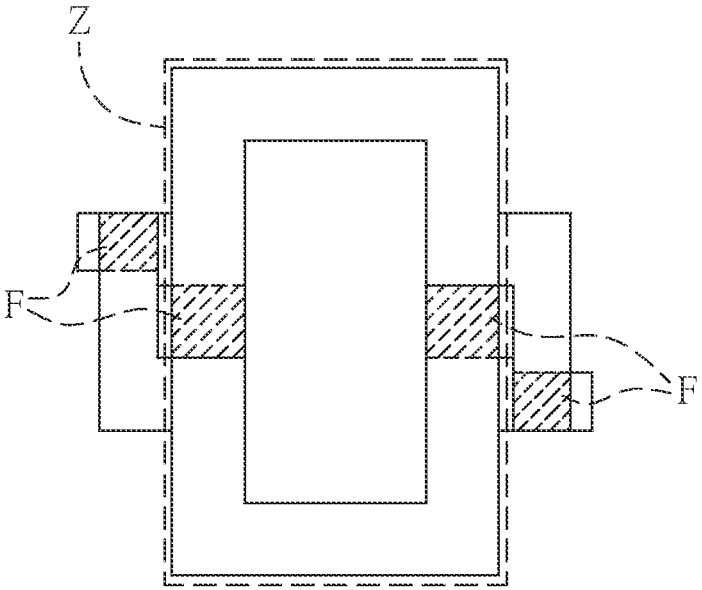
FIG. 3E is a top view of the coil of FIG. 3C.

FIG. 3A is a schematic diagram showing a coil according to a third embodiment of the invention, FIG. 3B is a schematic diagram showing a wound coil of FIG. 3A, FIG. 3C is a perspective view of a stacked coil of FIG. 3A, FIG. 3D is a side view of the coil of FIG. 3C, and FIG. 3E is a top view of the coil of FIG. 3C.

As shown in FIG. 3A, the coil 6 includes a coil string 6*a* and a coil string 6*b*, which are composed of a plurality of continuous coil sections 60*a* and 60*b* by pressing a single metal sheet. The coil sections 60*a* and 60*b* are alternately configured, and each of the coil strings 6*a* and 6*b* contains three coil section 60*a* and two coil sections 60*b*. The width d of the coil sections 60*a* and 60*b* is, for example but not limited to, 1 cm. Each of the coil sections 60*a* and 60*b* includes a body portion 60 and a direct connecting portion 61 or a protrusive connecting portion 62. The direct connecting portion 61 or the protrusive connecting portion 62 is disposed at one end or two ends of the body portion 60. From the left to the right, the coil section 60*a* includes a direct connecting portion 61 and a protrusive connecting portion 62, and the coil section 60*b* includes a direct connecting portion 61 and a protrusive connecting portion 62.

Referring to FIGS. 3A to 3E, in the coil string 6*a*, the direct connecting portion 61 of the coil section 60*a* is directly connected with the direct connecting portion 61 of the coil section 60*b* (with one folding line), and the protrusive connecting portion 62 of the coil section 60*b* is directly connected with the protrusive connecting portion 62 of the next coil section 60*a* (with one folding line). Accordingly, the folding procedure of the coil string 6*a* can be finished by folding the direct connecting portions 61 or the protrusive connecting portions 62 of the adjacent coil sections 60*a* (along the dotted folding line). After folding the coil string 6*b* by the same procedure, the coil string 6*a* and the coil string 6*b* can respectively form a half wind and alternately twisted in a dual spiral structure (see FIG. 3B). As a result, the two coil sections 60*a* and 60*b* can form a twisted spiral path around the central axis C stacked as shown in FIG. 3C. After folding the multiple coil sections 60*a* and 60*b*, the coil 6 contains the protrusive connecting portions 62 and the rectangular main coil zone Z (see dotted block of FIG. 3E surrounding the central axis C) composed of the body portions 60 and the direct connecting portion 61. The protrusive connecting portions 62 protrude out at the path location of the direct connecting portions 61. That is, the protrusive connecting portions 62 protrude out of the main coil zone Z. Two connected coil sections form only one overlapped surface F (see the dotted-line area in FIG. 3E) at the coupled parts of the direct connecting portions 61 or the protrusive connecting portions 62. FIG. 3C shows two twisted groups of coils, and these two groups of coils are connected in parallel or in serial, or separated according to the user requirements.

In this embodiment, the body portions 60 of the coil sections 60*a* and 60*b* are substantially U-shaped. As shown in FIG. 3C, the coil section 60*a* of the coil string 6*a* and the coil section 60*b* of the coil string 6*b* form a wind (a basic unit of the spiral path). Regarding to the body portions of the coil sections 60*a* of the coil string 6*a* and 6*b*, along the spiral path the top surface of the second end e2 has a virtual extension reaching the first end e1 of the body portions of the coil sections 60*a* of the coil strings 6*a* and 6*b*. As shown in the figures, the virtual extension of the top surface of the second end e2 and the first end e1 are substantially located at the same plane (see FIGS. 3C and 3D). In practice, except for the above configuration, one surface of the second end e2 may have a virtual extension located between two surfaces of the first end e1 along the spiral path, or one surface of the second end e2 may have a virtual extension penetrating through one surface of the first end e1 along the spiral path. To be noted, the second end e2 is directly disposed on the direct connecting portion 61 and is also a part of the body portion 60*a*1. The first end e1 is disposed on the protrusive connecting portion 62 of the body portion 40*b*1, and the protrusive connecting portion 62 is connected with the first end e1 of the body portion 60*b*1.

Figure 4:
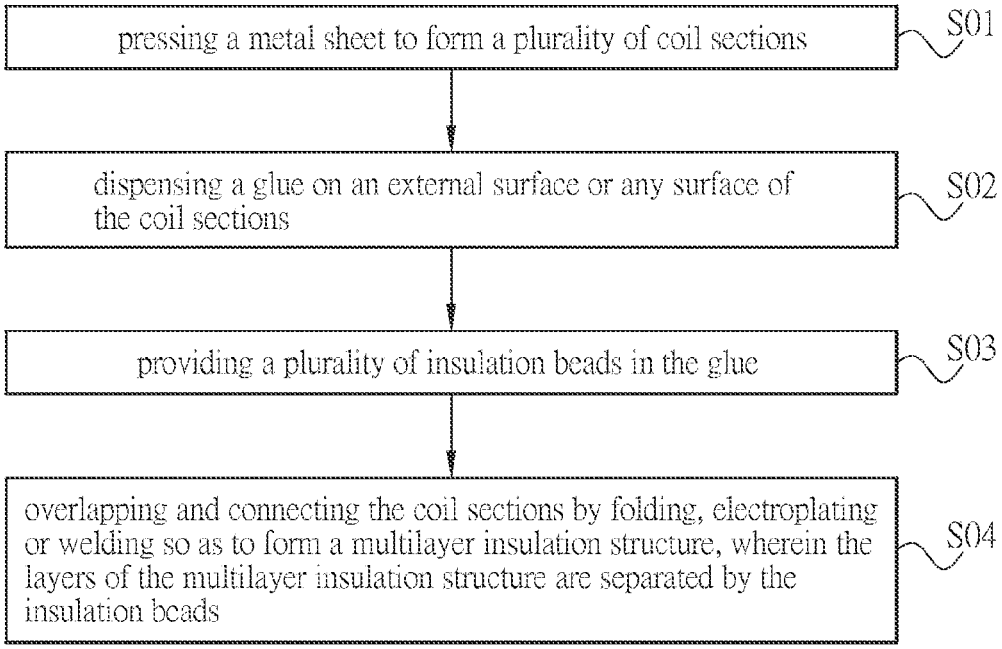
FIG. 4 is a flow chart showing a manufacturing method of a coil according to an embodiment of the invention.
Figure 5:
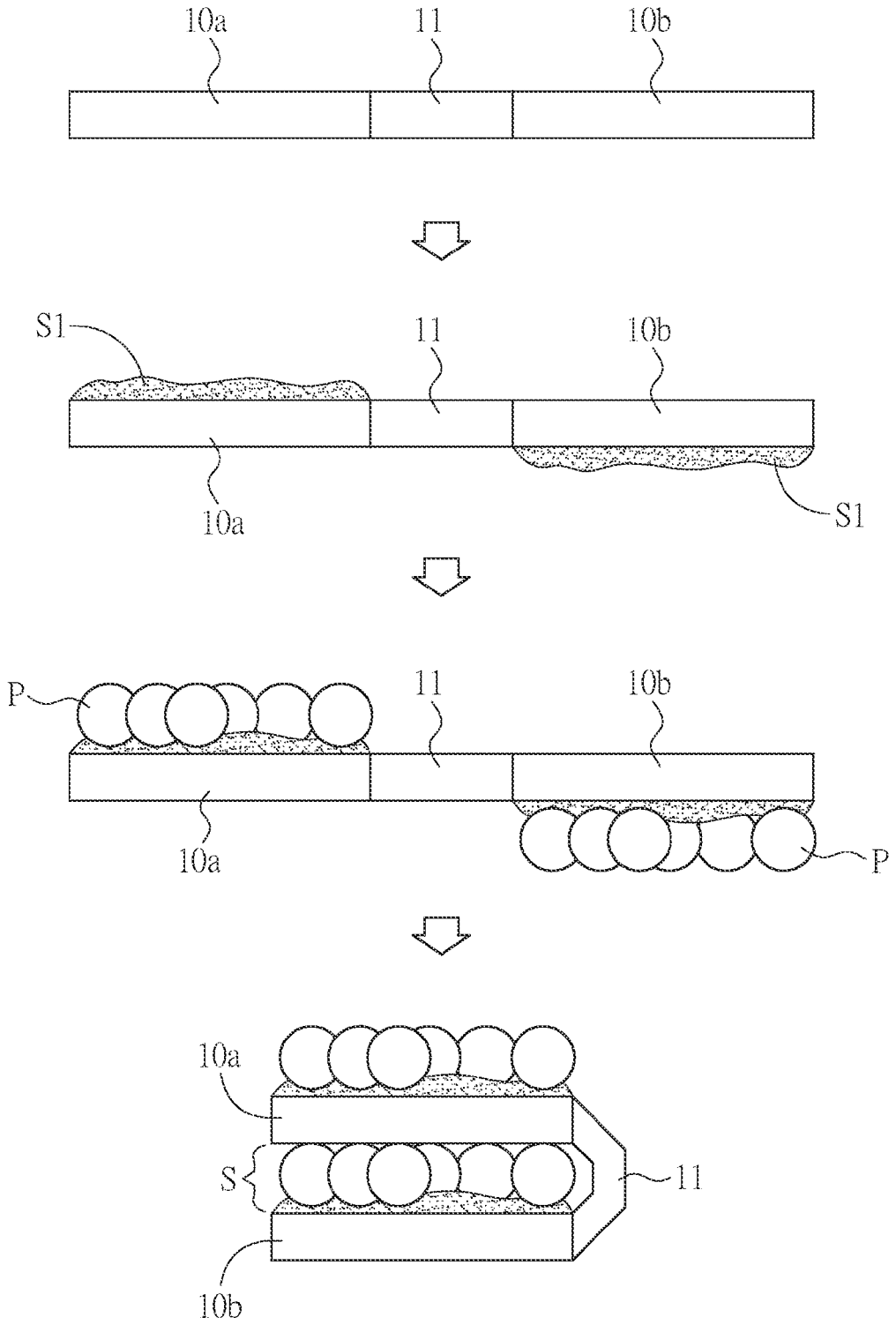
FIG. 5 is a schematic diagram showing a part of the coil sections configured with an isolation body.

FIG. 4 is a flow chart showing a manufacturing method of a coil according to an embodiment of the invention, and FIG. 5 is a schematic diagram showing a part of the coil sections configured with an isolation body. The coils of the first to third embodiments can be manufactured by the manufacturing method of a coil as shown in FIG. 4. To clarify the relations between the flow chart and the other drawings, the following example illustrates the manufacturing method of a coil applied to fold the coil sections 10*a* and 10*b* of the first embodiment.

The manufacturing method of a coil of the invention includes the following steps S01 to S04. The step S01 is to press a metal sheet to form a plurality of coil sections 10*a* and 10*b*. The step S02 is to dispense a glue S1 on an external surface or any of the coil sections 10*a* and 10*b*. In the step S03, a plurality of insulation beads P are provide in the glue S1. The step S04 is to overlap and connect the coil sections 10*a* and 10*b* by folding, electroplating or welding so as to form a multilayer insulation structure. Herein, the coil section 10*b* is stacked on the coil section 10*a*, and an insulation body S composed of the glue S1 and the insulation beads P is interposed between the coil sections 10*a* and 10*b* for separating the coil sections 10*a* and 10*b*. Besides, the steps S02 and S03 can be combined into a single process. For example, the insulation beads P and the glue S1 are mixed in advance, and then the mixture is spread on the external surface or any surface of the coil sections 10*a* and 10*b*.

The coil can be manufactured by folding and stacking more coil sections depending on the product requirement. If necessary, a baking step may be provided to solidify the insulation beads P and the glue S1 so as to form the insulation body S. To be noted, the scales of the insulation beads P and the glue S1 are enlarged in FIG. 5 for illustration purpose.

Accordingly, the multiple layers of the coil sections in the manufactured coil can be gapless or with a smallest gap, so that the space factor can be significantly increased. Besides, the shape of the coil sections is not limited and can be, for example, circular, rectangular, triangular, or polygonal. In this invention, the coil sections are formed by pressing or cutting a metal sheet, and then the coil sections are folded or welded to manufacture the desired coil. As mentioned above, the manufacturing procedure of the coil of the invention is simpler and faster than that of the conventional flat winding coil. The present invention is to fold and stack the coil sections for fabricating the desired coil, so that it is possible to manufacturing a multilayer flat coil with a fast and low cost approach.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A coil having a plurality of turns distributed along a central axis of the coil, each turn having at least two coil sections, each of the at least two coil sections comprising:

a body portion having a first end and a second end, and a top surface facing along one direction of the central axis of the coil, and a bottom surface facing the opposite direction to the top surface;

wherein the at least two coil sections are connected and partially overlapped by folding;

wherein each of the at least two coil sections except a last coil section at a last turn further comprises at least one connecting portion disposed at the second end of the body portion;

wherein in one turn of the coil, except a first end of a leading body portion at the beginning of the turn, the first end of the other body portions in a same turn is connected to the connecting portion disposed at a second end of a preceding body portion, and a second end of a ending body portion at the last of the same turn is aligned toward and kept distance from the first end of the leading body portion, and a cross section of the second end of the ending body portion is overlapped with a cross section of the first end of the leading body portion when viewed along the path of the turn.

2. The coil according to claim 1, wherein the at least two coil sections are connected by electroplating or welding.

3. The coil according to claim 1, wherein the at least two coil sections are formed by pressing a metal sheet so as to form the connected coil sections, and then the connecting portions are folded to form the coil.

4. The coil according to claim 1, wherein at least one of the coil sections in the plurality of turns has different width or different thickness.

5. The coil according to claim 1, wherein in the same one turn, when viewed along the direction of the central axis of the coil, the bottom surface at the first end of the leading body portion is not overlapped with the top surface at the second end of the ending body portion, and the top surface at the first end of the leading body portion is not overlapped with the bottom surface at the second end of the ending body portion.

6. The coil according to claim 1, wherein in the same one turn, when viewed along the direction of the central axis of the coil, the bottom surface at the second end of a body portion is overlapped with the top surface at the first end of its succeeding body portion, or the top surface at the second end of a body portion is overlapped with the bottom surface at the first end of its succeeding body portion.

7. The coil according to claim 1, wherein, between two connected coil sections the second end of the preceding coil section and the first end of the succeeding coil section form only one overlapped surface near the connecting portion, and in the same one turn, the top surface at the ending coil section's second end has an imaginary extension along the path of the turn reaching the leading coil section's first end, and such that the imaginary extension overlaps the top surface or penetrates through the cross section of the first end of the leading coil section.

* * * * *